US010493645B2

(12) United States Patent
Marinovich et al.

(10) Patent No.: US 10,493,645 B2
(45) Date of Patent: Dec. 3, 2019

(54) EMBEDDED BLADE CUTTERS

(71) Applicant: Pacific Handy Cutter, Inc., Irvine, CA (US)

(72) Inventors: Jacqueline Marinovich, Rancho Santa Fe, CA (US); Mark Marinovich, Rancho Santa Fe, CA (US); Joseph P. Garavaglia, Newport Beach, CA (US)

(73) Assignee: PACIFIC HANDY CUTTER, INC., Irvine, CA (US)

( * ) Notice: Subject to any disclaimer, the term of this patent is extended or adjusted under 35 U.S.C. 154(b) by 0 days.

(21) Appl. No.: 15/821,787

(22) Filed: Nov. 23, 2017

(65) Prior Publication Data

US 2018/0319029 A1 Nov. 8, 2018

Related U.S. Application Data

(63) Continuation-in-part of application No. 29/600,319, filed on Apr. 11, 2017.

(51) Int. Cl.

| | |
|---|---|
| ***B26B 29/02*** | (2006.01) |
| ***B26B 3/08*** | (2006.01) |
| ***B25G 1/10*** | (2006.01) |
| ***A45F 5/02*** | (2006.01) |

(52) U.S. Cl.

CPC ..... *B26B 29/02* (2013.01); *A45F 5/02* (2013.01); *B25G 1/102* (2013.01); *B26B 3/08* (2013.01)

(58) Field of Classification Search

CPC .. B26B 29/02; B26B 3/08; A45F 5/02; B25G 1/102

USPC ..... 30/280, 287, 294

See application file for complete search history.

(56) References Cited

U.S. PATENT DOCUMENTS

| | | | | |
|---|---|---|---|---|
| 5,737,842 | A * | 4/1998 | Freedman | B26B 3/00 30/280 |
| D401,492 | S * | 11/1998 | Joseph, Jr. | D8/98 |
| D571,180 | S * | 6/2008 | Marshall | D8/98 |
| D575,613 | S * | 8/2008 | Jennings | D8/98 |
| 7,818,885 | B2 * | 10/2010 | Lafauci | A61B 17/3211 30/280 |
| D637,883 | S * | 5/2011 | Yu Chen | D8/98 |
| D655,996 | S * | 3/2012 | Ireland | D8/100 |
| D801,148 | S * | 10/2017 | Yu Chen | D8/98 |
| 2013/0305542 | A1 * | 11/2013 | McChesney | B26B 1/08 30/162 |
| 2018/0319029 | A1 * | 11/2018 | Marinovich | B26B 29/02 |

* cited by examiner

*Primary Examiner* — Hwei-Siu C Payer
(74) *Attorney, Agent, or Firm* — Peter L. Holmes

(57) ABSTRACT

A hand-held cutting tool includes a handle, at least one cutting head with an embedded blade, the at least one cutting head being connected to the handle, and a clip connected to the handle within a recess thereof, the clip including a resilient member extending generally lengthwise along the handle. Each of the cutting head(s) is connected to the handle at an end thereof (i.e., at one or the other of two ends of the handle along a lengthwise portion thereof). The clip is connected at a base portion thereof to the handle at a location within (e.g., an interconnection location or juncture of) the recess. The clip is only connected to or in contact with the handle at the location independent of whether the resilient member (of the clip) flexes or otherwise repositions in relation to the base portion of the clip.

17 Claims, 17 Drawing Sheets

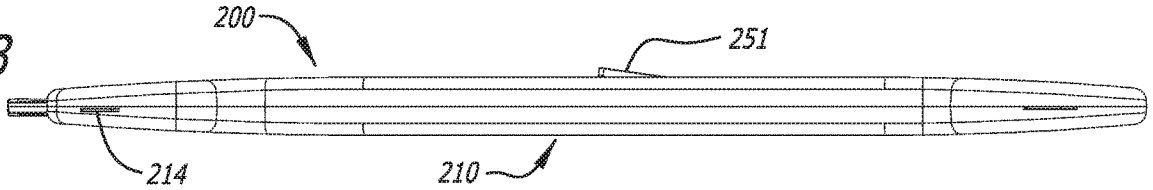
FIG. 23
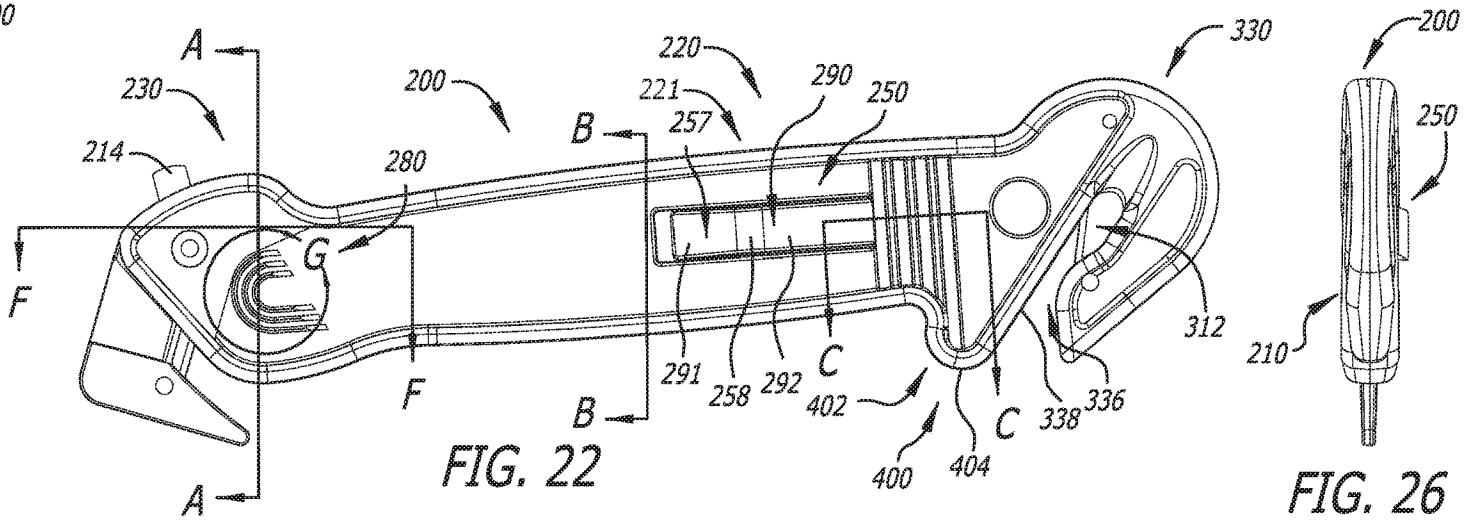
FIG. 22
FIG. 26
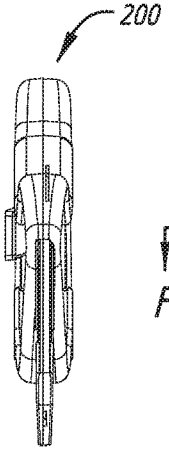
FIG. 25
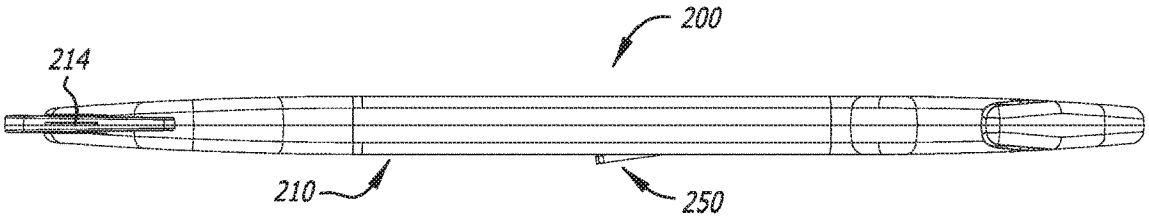
FIG. 24

EMBEDDED BLADE CUTTERS

CROSS-REFERENCE TO RELATED APPLICATIONS

This application is a continuation-in-part of U.S. Design patent application Ser. No. 29/600,319, entitled "Embedded Blade Cutter" filed on Apr. 11, 2017 and a continuation-in-part of U.S. Design patent application Ser. No. 29/600,323, entitled "Embedded Blade Cutter" filed on Apr. 11, 2017, which are both hereby incorporated by reference.

TECHNICAL FIELD

The present invention relates generally to cutters and cutter apparatuses, in particular, hand-held cutting tools including at least one cutting head with an embedded blade, and a recessed handle clip and interconnection interface structures.

BACKGROUND ART

A great variety of knives, cutters, safety cutters, and cutter apparatuses are known. Features variously found in prior knives, cutters, safety cutters, and cutter apparatuses include mechanisms and devices facilitating, for example, blade deployment, blade change, or blade storage.

It is known to provide a safety cutter with a guard (or guide) located a short distance from and facing a side of the cutting blade. See e.g., U.S. Pat. Nos. 5,386,632, 6,314,646 B1, D544,774 S, and 7,987,602 B2, which are hereby incorporated by reference.

It would be useful to be able to provide a hand-held cutting tool with a mechanism or device that facilitates one or more of improved, advantageous, or otherwise desirable or useful cutter qualities and/or performance and/or providing of synergistic structural features relating to same.

SUMMARY OF THE INVENTION

In an example embodiment, a hand-held cutting tool includes a handle, at least one cutting head with an embedded blade, the at least one cutting head being connected to the handle, and a clip connected to the handle within a recess thereof, the clip including a resilient member extending generally lengthwise along the handle.

In an example embodiment, a hand-held cutting tool includes a handle configured for gripping by a hand about a lengthwise gripping portion of the handle between opposite ends thereof, two cutting heads, at the opposite ends of the handle, respectively, the cutting heads each providing at least part of or including an embedded blade cutter, and a clip connected to the handle between the two cutting heads.

In an example embodiment, a hand-held cutting tool includes a handle configured for gripping by a hand, the handle including a recess at a side portion thereof, a cutting head at a distal end of the handle, and a clip connected at a base portion thereof to the handle within the recess, the clip only being connected to or in contact with the handle at an interconnection interface that includes a bottom portion of the recess and a side wall portion of the recess.

BRIEF DESCRIPTION OF THE DRAWINGS

FIGS. 22-27 are left side, top, bottom, front, back and right side views, respectively, of the cutter apparatus of FIG. 21;

If not otherwise indicated, example dimensions are in millimeters.

DISCLOSURE OF INVENTION

Figure 1:
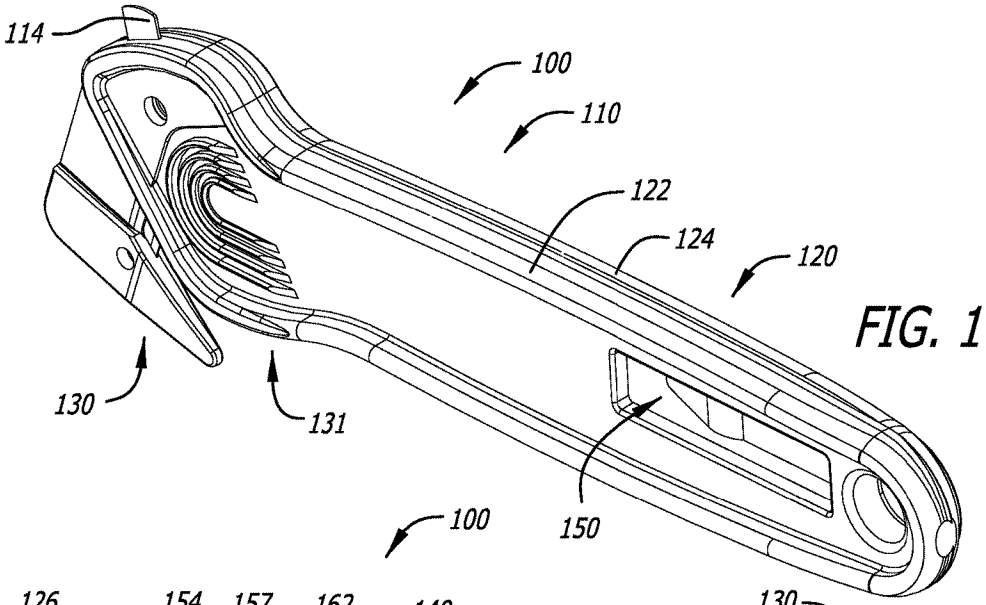
FIG. 1 is an isometric perspective view of an example embodiment of a cutter apparatus.
Figure 2:
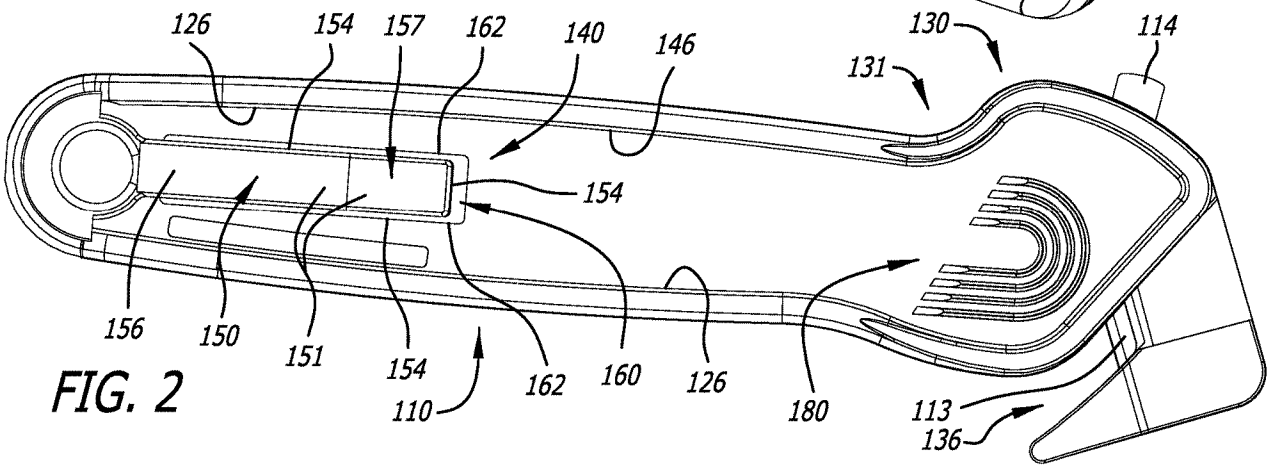
FIGS. 2-6 are right side, front, left side, back and top views, respectively, of the cutter apparatus of FIG. 1.
Figure 3:
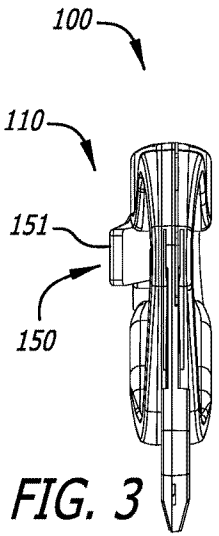
Figure 7:
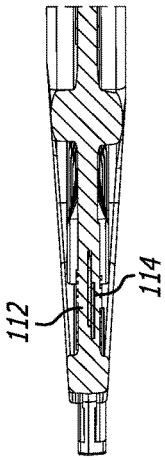
FIG. 7 is a cross-sectional view of the cutter apparatus along lines F-F of FIG. 4 showing embedded blade and tape splitter elements secured within a cutting head.
Figure 6:
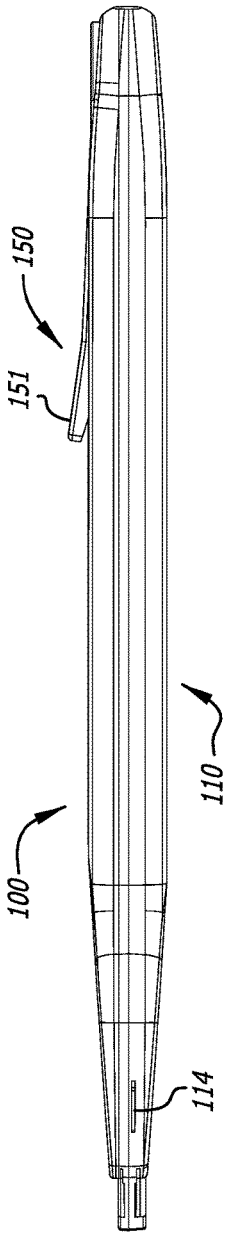
Figure 5:
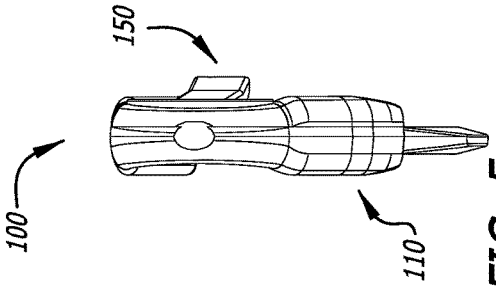
Figure 4:
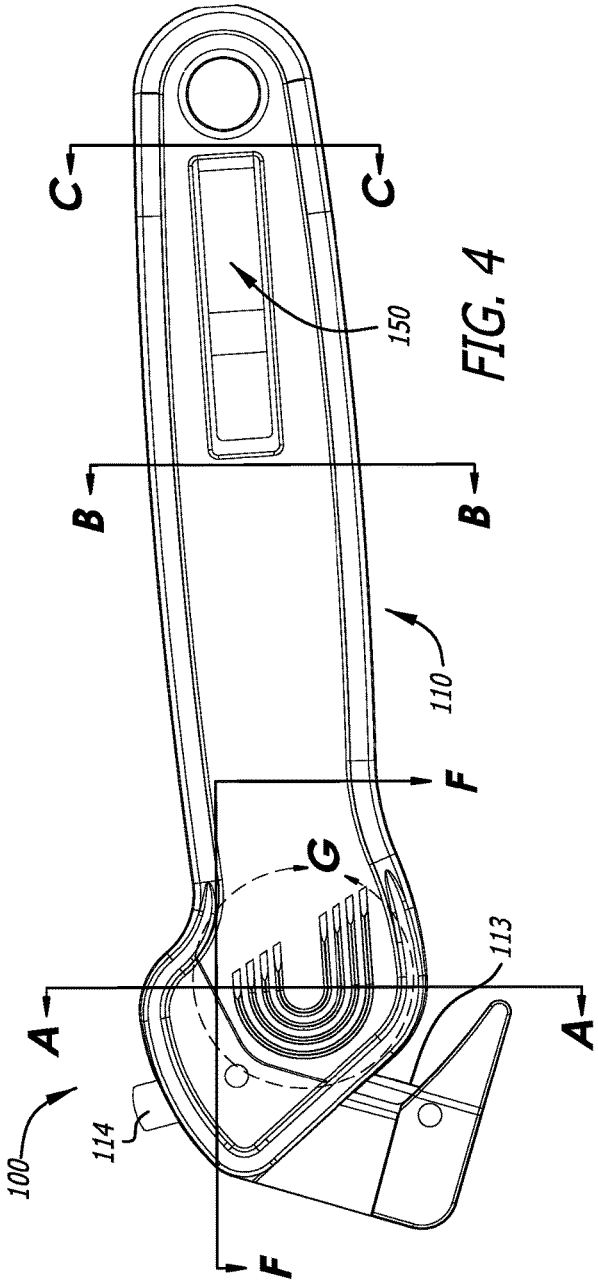
Figure 8:
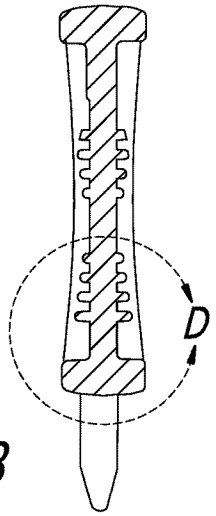
FIG. 8 is a cross-sectional view of the cutter apparatus along lines A-A of FIG. 4 showing generally U-shaped gripping ridges at left and right distal side portions of the handle.
Figure 9:
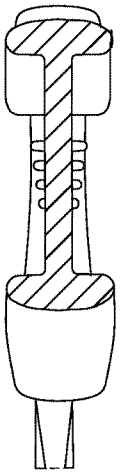
FIG. 9 is a cross-sectional view of the cutter apparatus along lines B-B of FIG. 4 showing side wall surfaces defining recesses at opposite (the left and right) sides of the handle.
Figure 10:
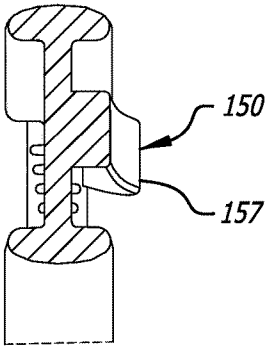
FIG. 10 is a cross-sectional view of the cutter apparatus along lines C-C of FIG. 4 showing an interconnection support structure and a clip extending therefrom.
Figure 11:
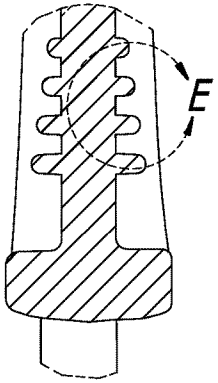
FIG. 11 is a cross-sectional magnified view of the portion of FIG. 8 denoted DETAIL D showing portions of the U-shaped gripping ridges in profile.
Figure 12:
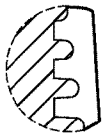
FIG. 12 is a cross-sectional view showing in isolation the portion of FIG. 11 denoted DETAIL E.
Figure 13:
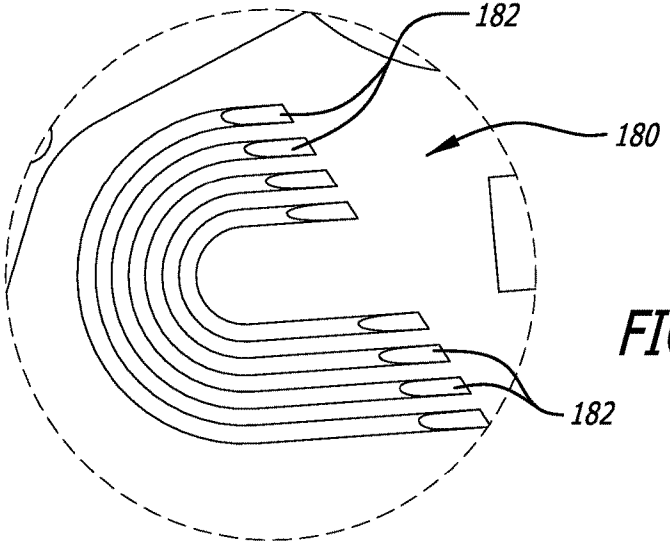
FIG. 13 is a magnified view of DETAIL G (of FIG. 4) showing the U-shaped gripping ridges at the left side of the cutter apparatus.
Figure 14:
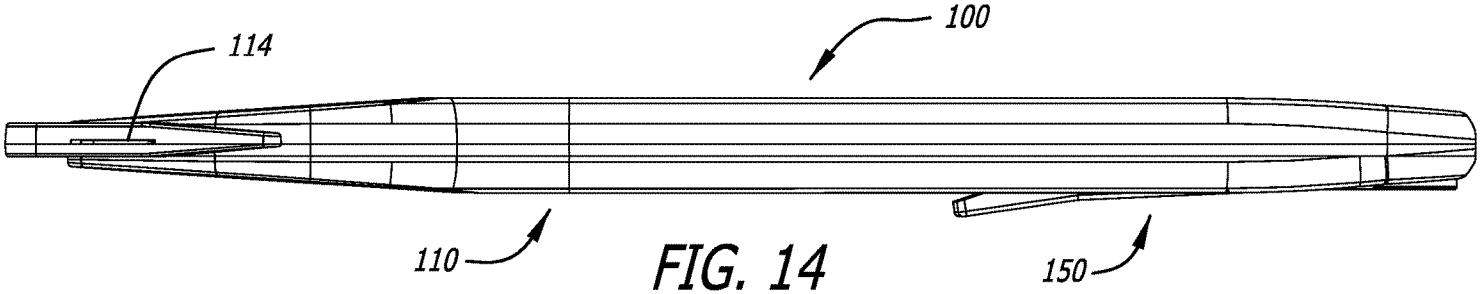
FIG. 14 is a bottom view of the cutter apparatus of FIG. 1.
Figure 15:
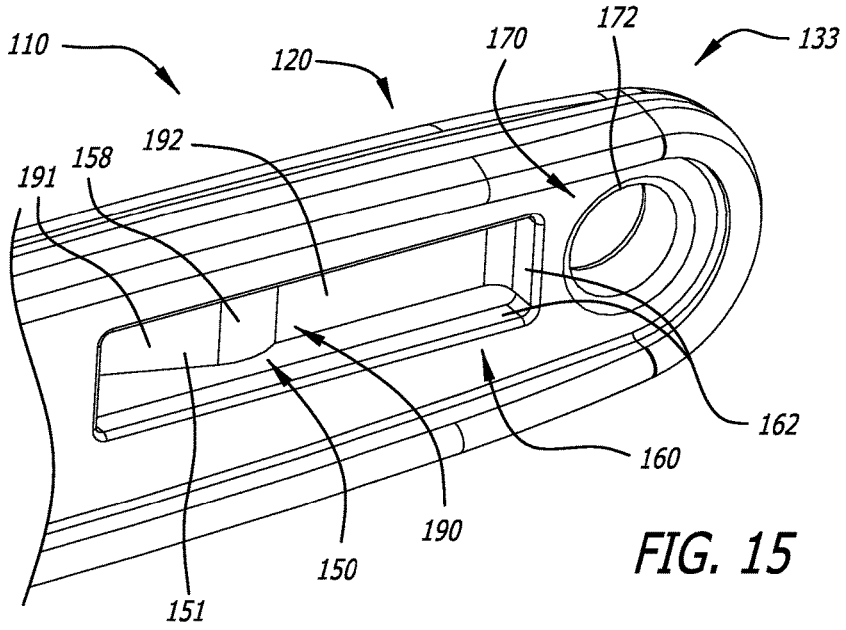
FIG. 15 is an isometric perspective view of the proximal end of the handle showing an opening of the handle and (facing the opening) a clip connected at a base portion thereof to the handle.
Figure 16:
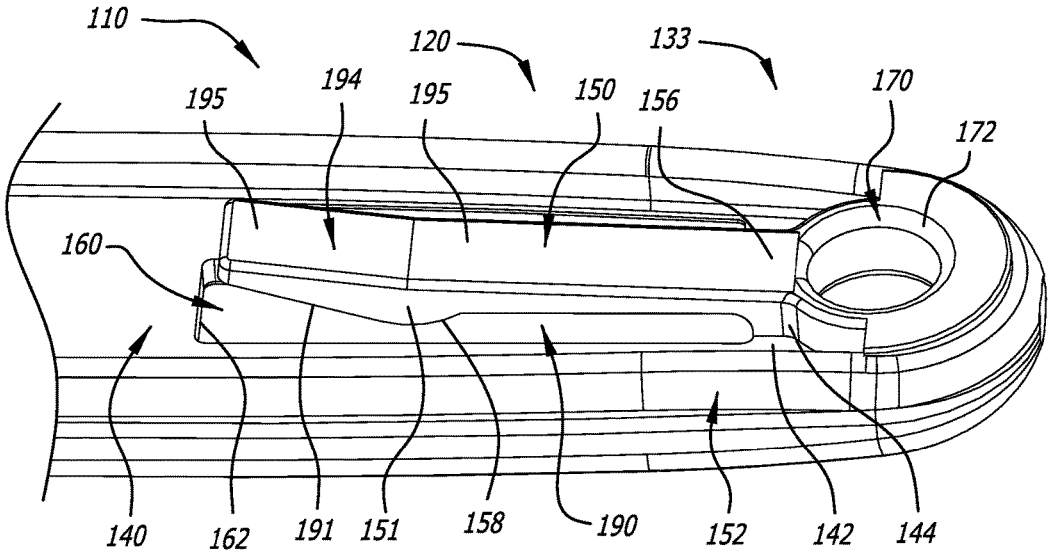
FIG. 16 is another isometric perspective view of the proximal end of the handle showing a recess of the handle and a connection interface at which the clip is connected to the handle, the connection interface including a bottom portion of the recess and a side wall portion of the recess (periphery portion of an annular or ring-like wall structure)
Figure 17A:
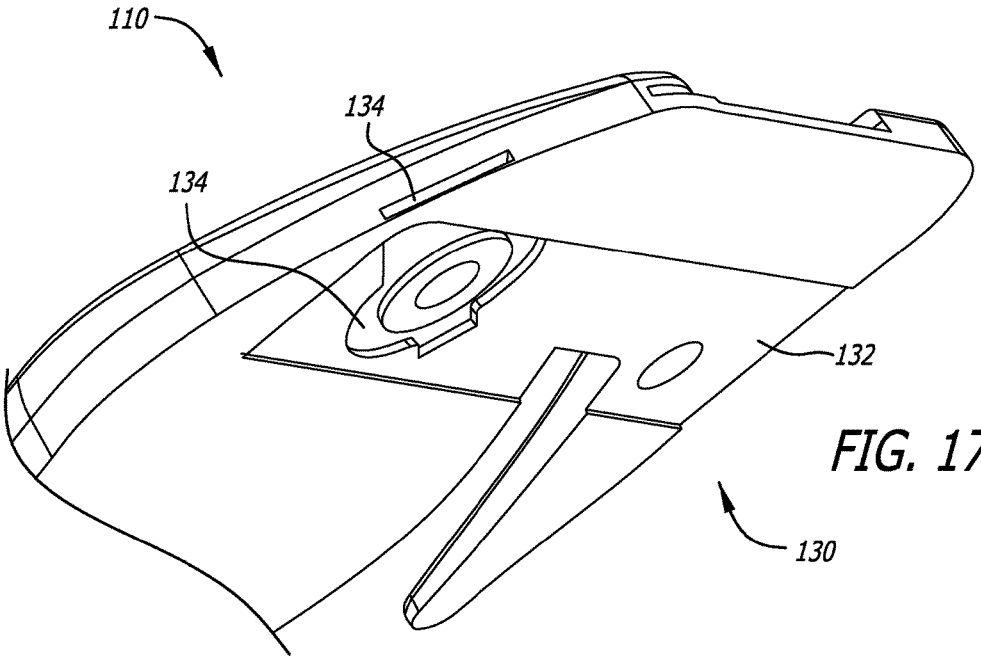
FIG. 17A is a cross-sectional isometric perspective view of the distal end of the cutter apparatus showing a blade receiving recess/channel and (adjacent thereto) a tape splitter recess/channel—the blade and the tape splitter are not shown in this view.
Figure 17B:
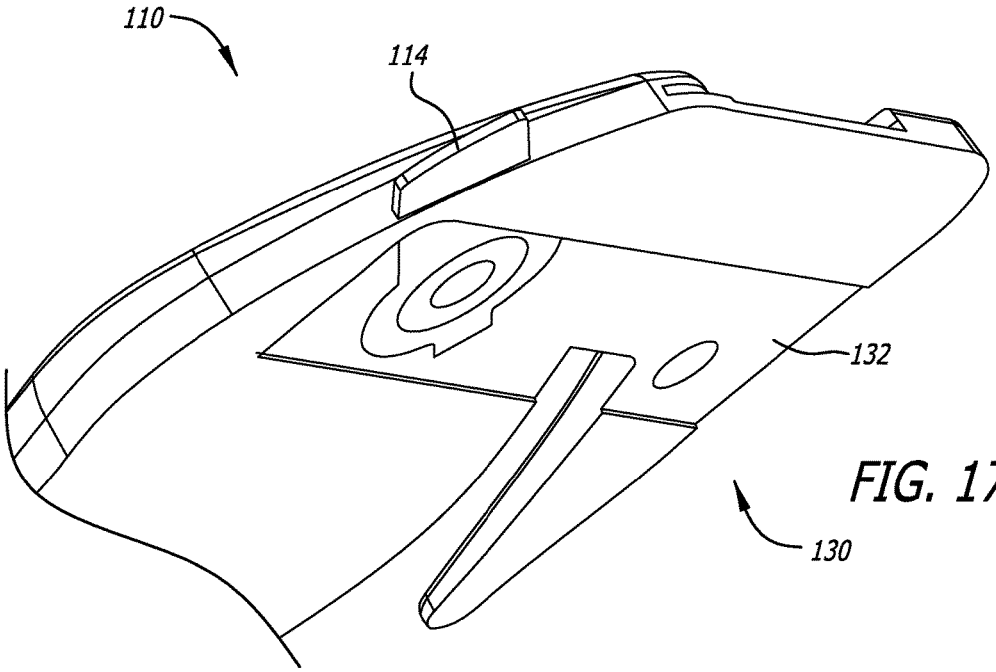
FIG. 17B shows the cross-sectional isometric perspective view of FIG. 17A with the tape splitter positioned within the tape splitter recess/channel and extending from an opening in the cutting head (defined by the tape splitter recess/channel)
Figure 18A:
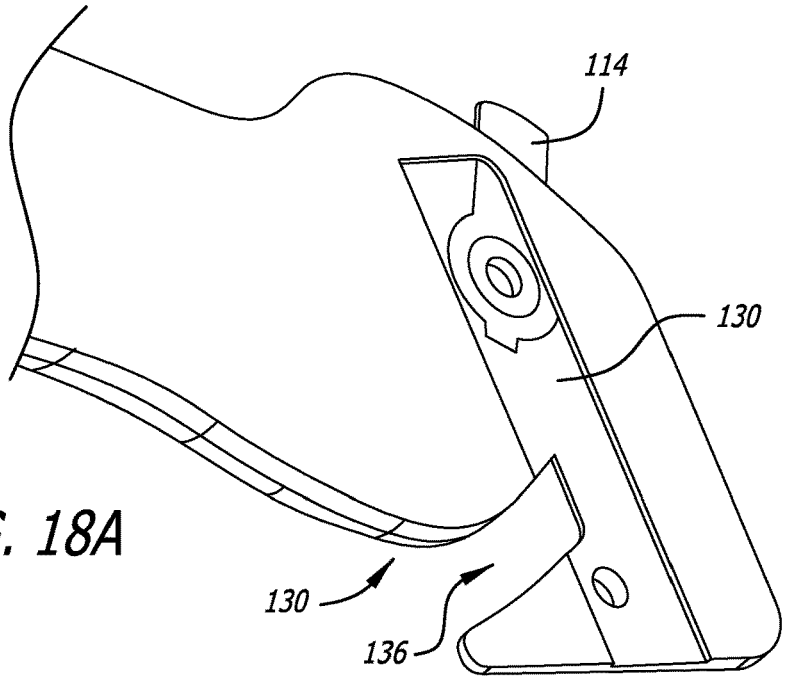
FIG. 18A is another cross-sectional isometric perspective view of the distal end of the cutter apparatus showing the blade receiving recess/channel and the tape splitter secured within the tape splitter recess/channel—the blade is not shown in this view (to also show a cutting channel that extends into the blade receiving recess/channel to expose the cutting portion of a blade secured within the blade receiving recess/channel)
Figure 18B:
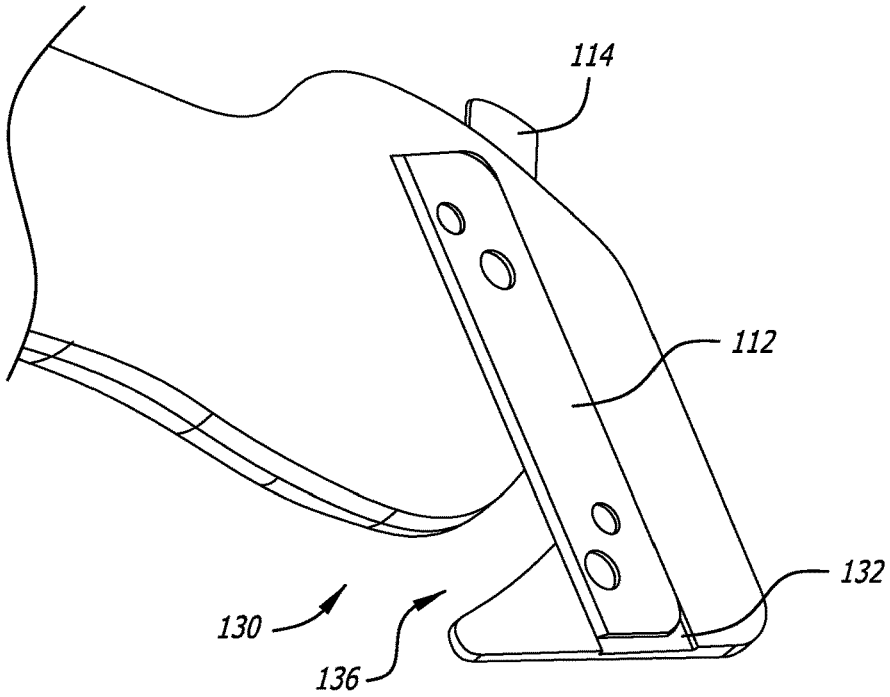
FIG. 18B shows the cross-sectional isometric perspective view of FIG. 18A with the blade positioned within the blade receiving recess/channel.
Figure 19:
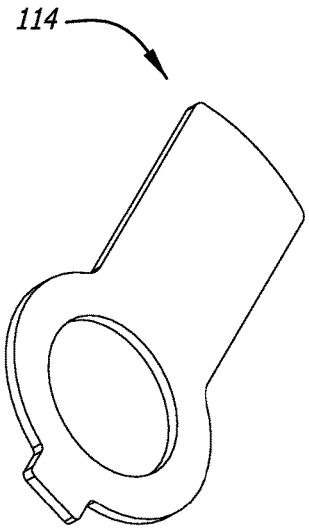
FIG. 19 is an isometric perspective view of an example tape splitter including a keyed end portion that interfits with the tape splitter recess/channel.
Figure 20:
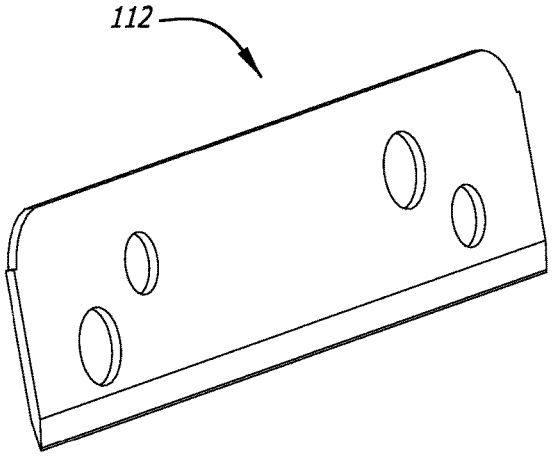
FIG. 20 is an isometric perspective view of an example blade including openings that receive posts or other structures for securing the blade within the blade receiving recess/channel.
Figure 20A:
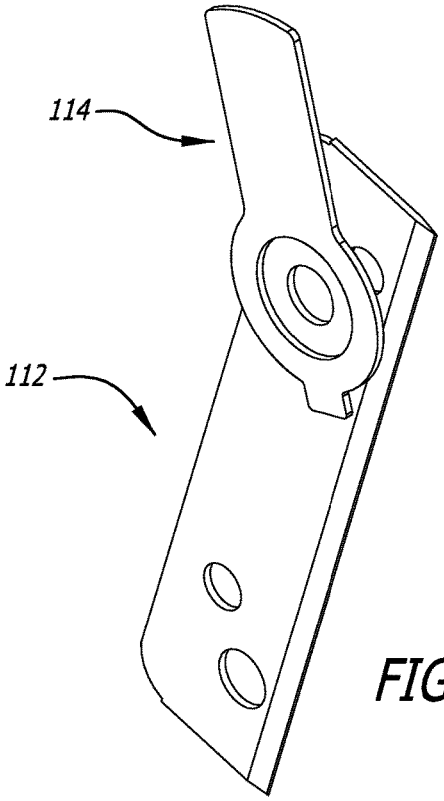
FIG. 20A is an isometric perspective view showing in isolation the tape splitter and blade adjacent to each other when secured within the tape splitter recess/channel and the blade receiving recess/channel, respectively.
Figure 21:
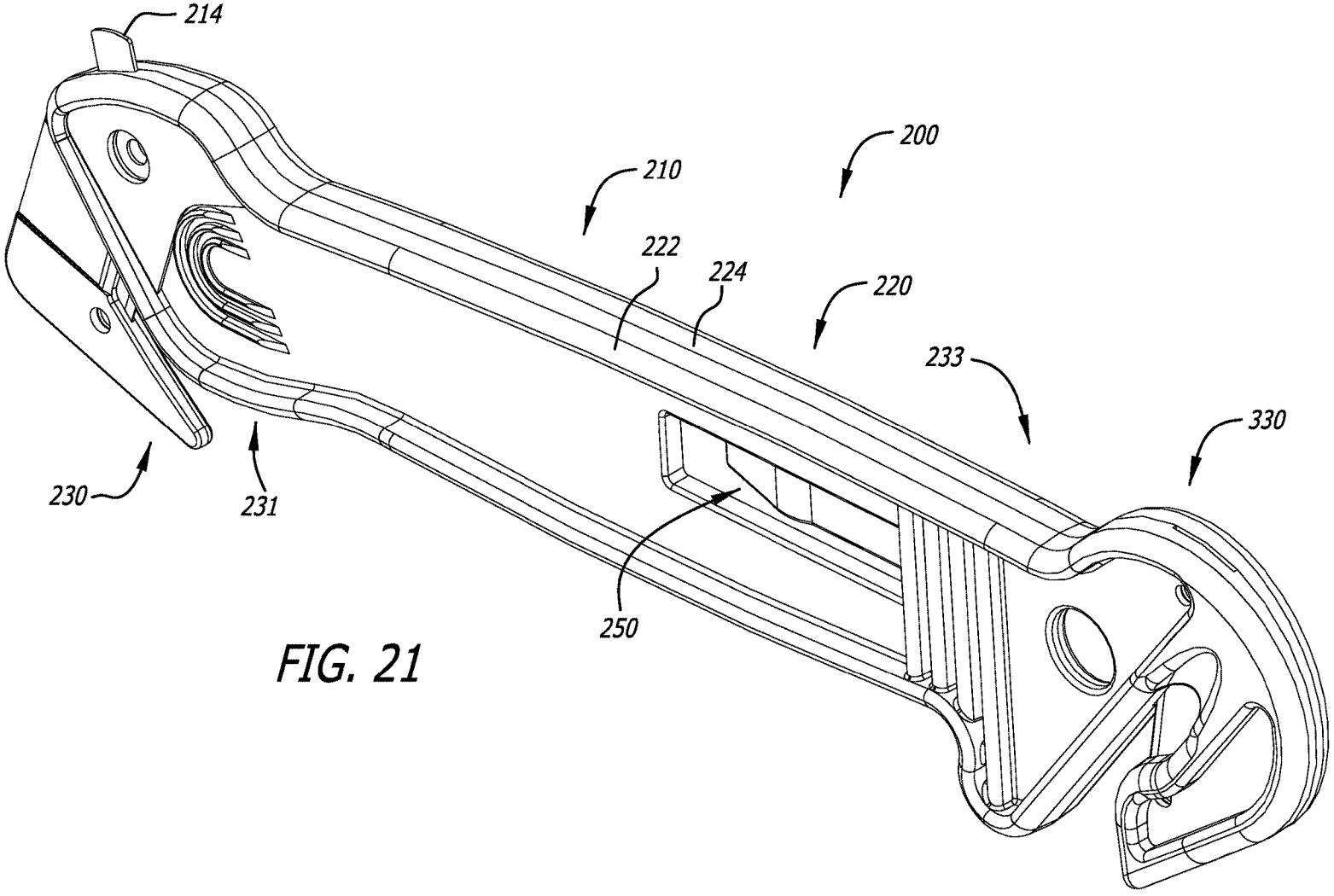
FIG. 21 is an isometric perspective view of another example embodiment of a cutter apparatus.

Referring to FIGS. 1-20A, in an example embodiment, a hand-held cutting tool (or cutting apparatus) 100 includes a housing 110 (e.g., shaped to be hand-held as shown), an embedded blade (or blade) 112 and a tape splitter (or tape splitter component) 114. The housing 110 includes a handle (or handle portion) 120, and has a left side 122 and a right side 124 at opposite sides of the blade 112 and the tape splitter 114. The housing 110 includes a cutting head (portion) 130 at a distal end 131 of the handle 120. As shown in FIGS. 2 and 16, the handle 120 includes a recess 140 at a side portion thereof (e.g., a recessed side portion/area of the handle as shown). The housing 110 also includes a clip 150 that is connected to (or integrally formed with) the handle 120, the clip 150 including a resilient member 151 extending generally lengthwise along the handle (e.g., shaped/configured as shown). The housing 110 can be formed of various materials, for example, a moldable composite material (e.g., a material: glass-filled polymer or glass-filled plastic (GF), polytetrafluoroethylene (PTFE) nylon), and by various processes (e.g., insert molded). For example, the housing 110 can be molded or otherwise formed around the blade 112 and the tape splitter 114 such that the left and right sides of the housing are (permanently) positioned in relation to each other with the blade 112 and the tape splitter 114 secured therebetween and adjacent to each other (FIG. 7). The term "embedded blade" can refer (for example) to a blade that is secured within or to or otherwise connected to a cutting head and/or handle of a hand-held cutting tool. The blade 112 can be formed of various materials, for example, steel (e.g., SAE 1095 steel heat treated to HRC 58-60). The tape splitter 114 can be formed of various materials, for example, steel (or a high strength plastic).

Referring to FIGS. 17A, 17B, 18A and 18B, the cutting head 130 includes the blade 112 secured within a blade receiving recess/channel 132, and the tape splitter 114 secured within a tape splitter (keyed) recess/channel 134 adjacent to the blade receiving recess/channel 132. The cutting head 130 includes a (cutting) channel 136 formed as shown and extending into the blade receiving recess/channel 132. When secured within the blade receiving recess/channel 132, a cutting portion 113 of the blade 112 is located (e.g., visible/exposed) within the channel 136.

Referring to FIG. 16, the clip 150 is only connected to or in contact with the handle 120 at an interconnection interface 152 that includes a bottom (surface/)portion 142 of the recess 140 and a side wall (surface/)portion 144 of the recess 140. The interconnection interface, at the bottom and side wall portions of the recess, can be described as approximately "right angled". Referring to FIGS. 15 and 16, the bottom (surface/)portion 142 of the recess 140 includes an opening 160 facing the clip 150 and provided through the handle 120 as shown. Referring additionally to FIG. 2, the handle 120 includes surfaces 162 that define the opening 160 including a periphery boundary of the opening (e.g., at a bottom surface of the recess) circumscribing or generally being co-aligned with side surfaces(/portions) 154 of the clip 150 though, in this example embodiment, not circumscribing a base (or base portion) 156 of the clip 150. The recess 140 has a periphery (or boundary) 146 defined (at least in part) by side wall surfaces(/portions) 126 of the handle 120 and/or the (contiguous) side surfaces(/portions) 154 of the clip 150. Accordingly, the clip 150 is connected at its base (portion) 156 to the handle at a location within (e.g., interconnection location or juncture of) the recess 140. The clip 150 is only connected to or in contact with the handle 120 at the location independent of whether the resilient member 151 of the clip 150 flexes or otherwise repositions in relation to the base (portion) 156 of the clip 150.

Thus, in an example embodiment, a hand-held cutting tool includes a handle configured for gripping by a hand, the handle including a recess at a side portion thereof, a cutting head at a distal end of the handle; and a clip (integrally formed with or) connected at a base portion thereof to the handle within the recess, the clip only being connected to or in contact with the handle at an interconnection interface that includes a bottom portion of the recess and a side wall portion of the recess. In example embodiments, the cutting head has a blade (an embedded blade) that is secured within or to or otherwise connected to the cutting head, a cutting portion thereof (of the blade) being located (e.g., visible/exposed) within a channel (or other opening, recess or the like) of the cutting head. In example embodiments, the cutting head provides (embodies) at least part of or includes an embedded blade cutter.

Referring to FIGS. 15 and 16, the handle 120 includes (and the recess 140 is in part defined by) an annular or ring-like wall structure 170 at a proximal end 133 of the handle, and the clip 150 (at its base portion 156) is (integrally formed with or) connected to a periphery portion of the wall structure at the side wall (surface/)portion 144 of the recess 140 (providing a side wall portion of the interconnection interface 152). The annular or ring-like wall structure 170 also defines, at its interior, an opening 172 as shown (e.g., a lanyard or hanger hole opening).

The clip 150 includes an angled end portion 157 (see also FIG. 10) at an opposite end of the clip in relation to the base portion 156, and the handle 120 includes (or is provided with) (concentric/equidistantly nested) generally U-shaped (raised) gripping ridges 180 (see also FIGS. 8, 9, 11 and 12) having beveled portions(/surfaces) 182 at the ends of each ridge (FIG. 13), the beveled portions 182 facing the angled end portion 157 of the clip 150 (FIG. 2).

Referring to FIGS. 15 and 16, the clip 150 includes an inwardly facing engagement portion 158 (for securing/clipping the tool to a pocket), e.g., a protrusion shaped/configured as shown, that is wider laterally in relation to the handle 120 than at either the base portion 156 or the angled end portion 157 of the clip 150. The clip 150 includes two generally planar surfaces 191, 192 at and defining different (non-adjacent) portions of an inward facing side 190 of the clip 150, the planar surfaces not being parallel in relation to each other (e.g., not located within respective planes that are parallel to each other). The engagement portion 158 transitions (curves) between the two generally planar surfaces 191, 192 (e.g., as shown). The clip 150 also includes two generally planar surfaces 195, 196 at and defining different (adjacent and contiguous) portions of an outward facing side 194 of the clip 150, the planar surfaces not being parallel in relation to each other (e.g., not located within respective planes that are parallel to each other).

Figure 27:
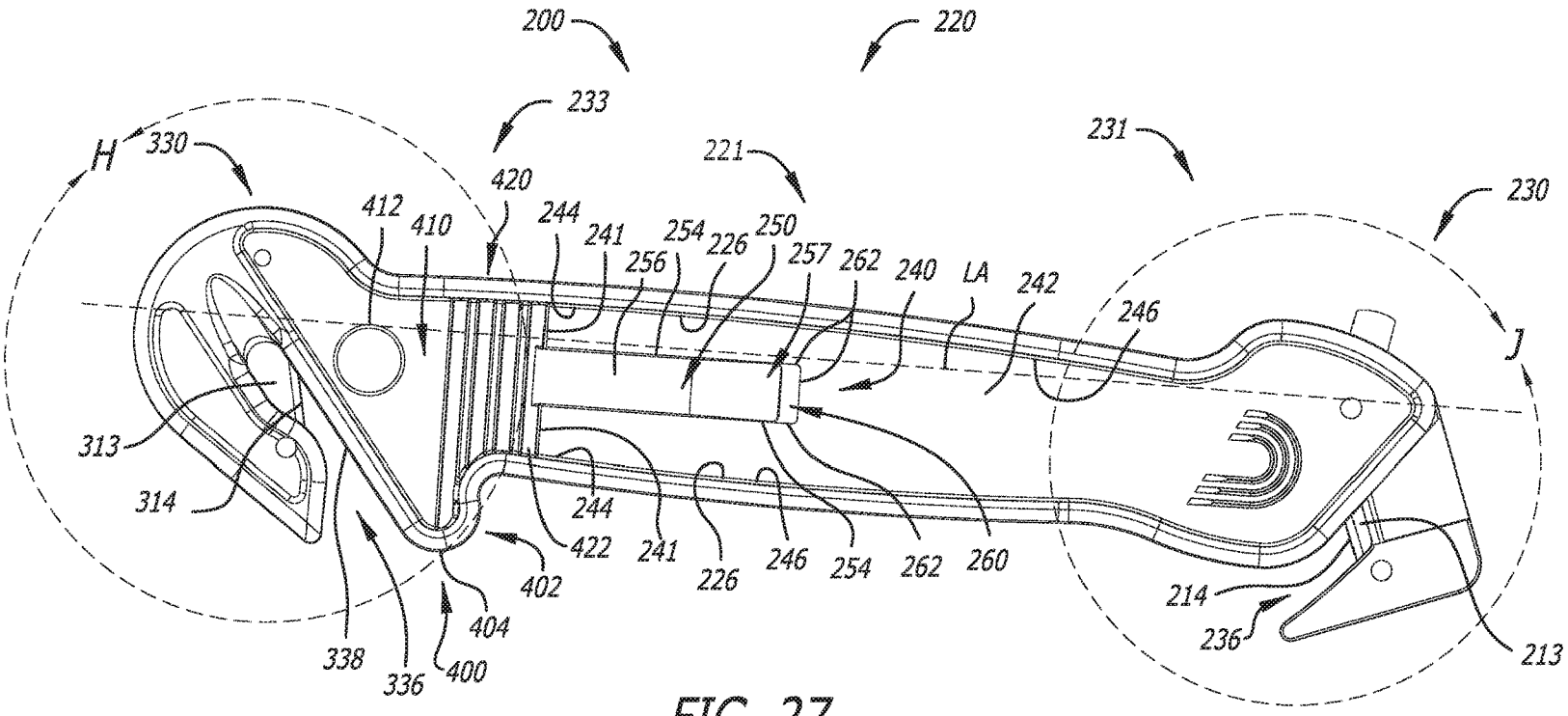
Figure 33:
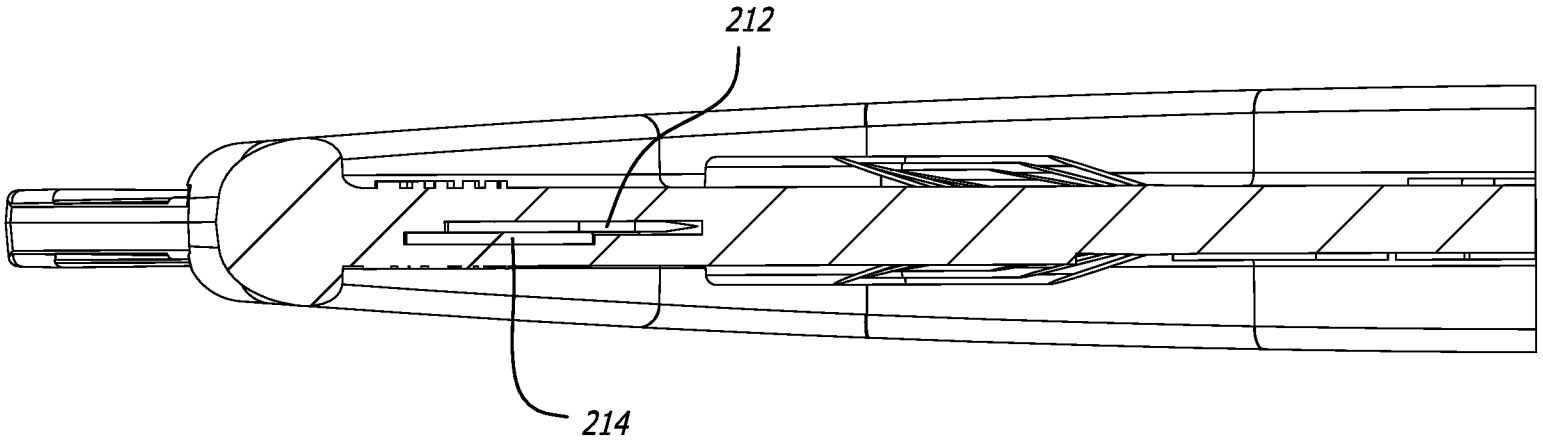
FIG. 33 is a cross-sectional view of the cutter apparatus along lines F-F of FIG. 22 showing embedded blade and tape splitter elements secured within a cutting head that includes a box cutter.
Figure 35:
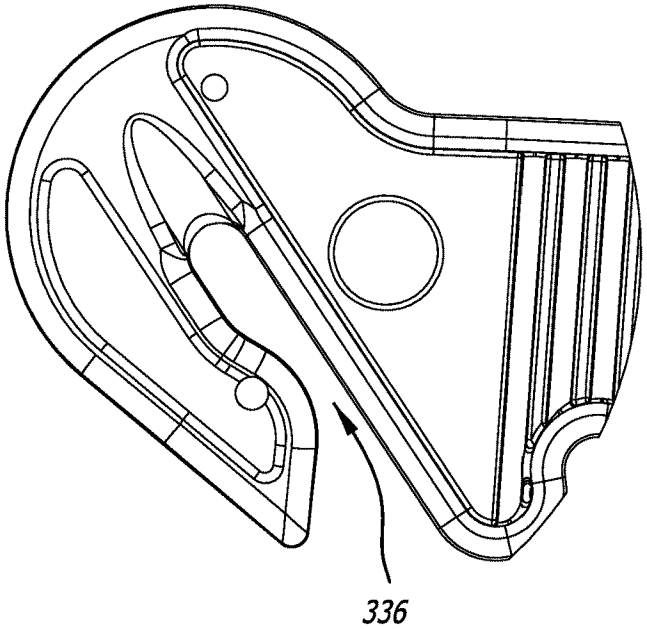
FIG. 35 is a magnified view of DETAIL H (of FIG. 27) showing an additional cutting head (of the cutter apparatus) that includes a film cutter.
Figure 34:
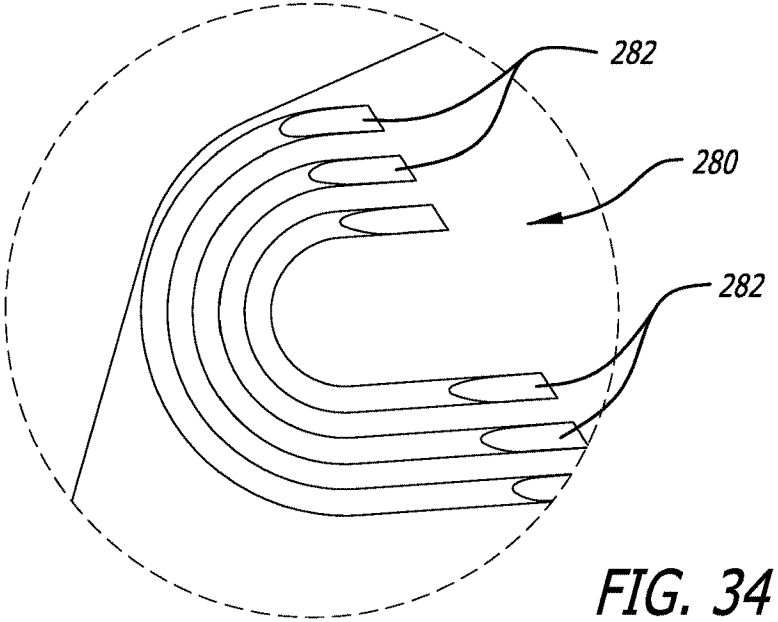
FIG. 34 is a magnified view of DETAIL G (of FIG. 22) showing the U-shaped gripping ridges at the left side of the cutter apparatus.
Figure 37:
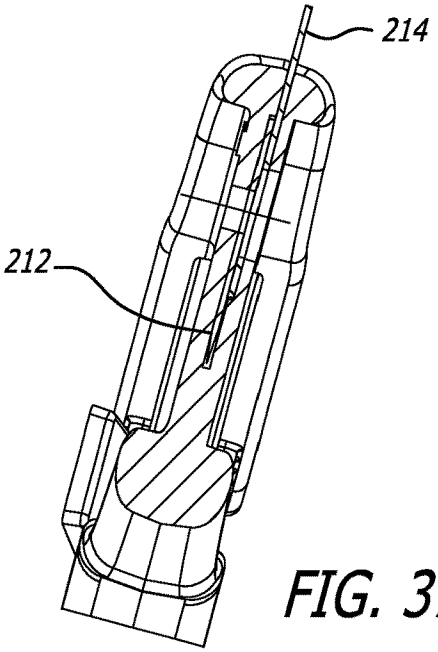
FIG. 37 is a cross-sectional magnified view along lines K-K of FIG. 36.
Figure 36:
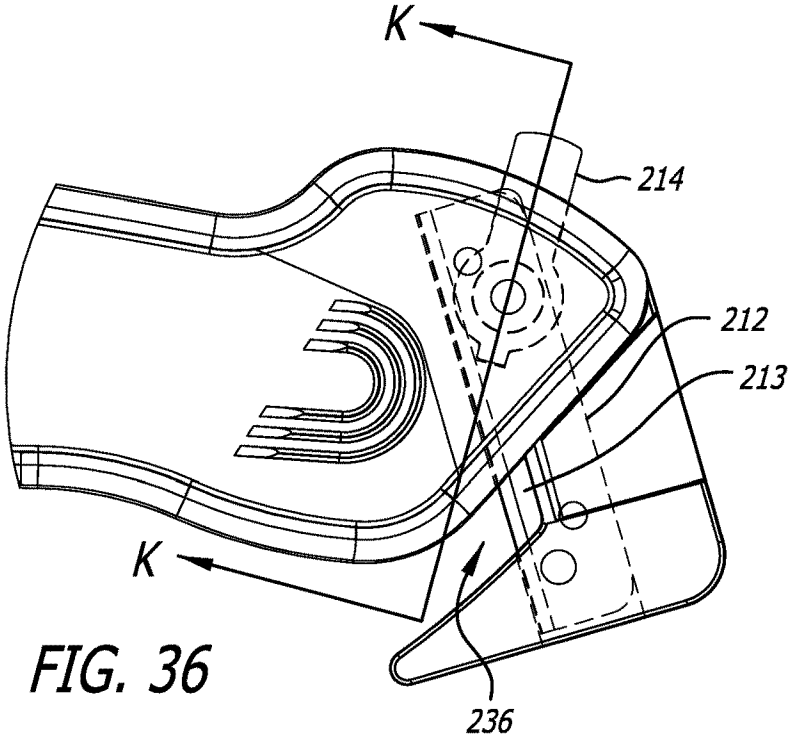
FIG. 36 is a magnified view of DETAIL J (of FIG. 27) showing (and interiorly, in broken lines) the tape splitter and the blade of the box cutter.
Figure 38A:
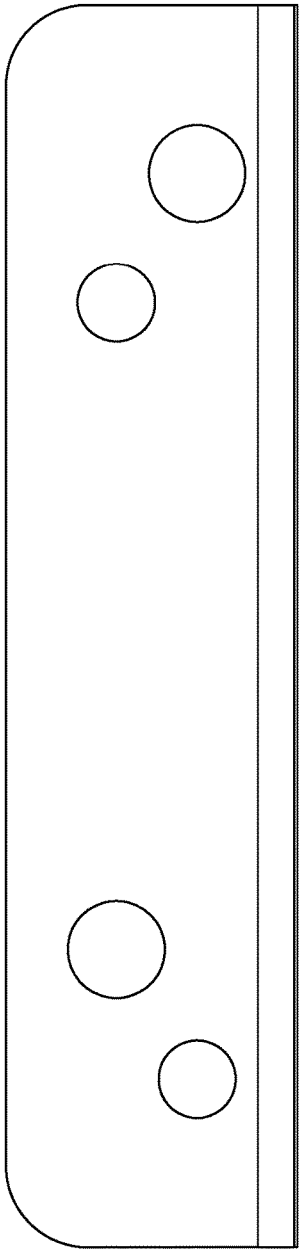
FIGS. 38A and 38B are side and end views, respectively, of an example blade (of one or more of the cutting heads) including openings that receive posts or other structures for securing the blade within a blade receiving recess/channel.
Figure 38C:
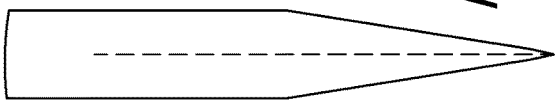
FIG. 38C is a magnified view of DETAIL A (of FIG. 38B)
Figure 38B:
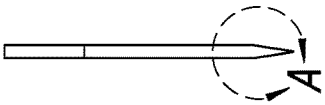

Referring to FIGS. 21-40, in another example embodiment, a hand-held cutting tool (or cutting apparatus) 200 includes a housing 210 (e.g., shaped to be hand-held as shown). The housing 210 includes two cutters (or cutting heads) at opposite ends of the handle, both or at least one of the cutters (or cutting heads) being an embedded blade cutter. In this example embodiment, the housing 210 includes a handle (or handle portion) 220, a first cutting head (portion) 230 at a distal end 231 of the handle 220 and a second cutting head (portion) 330 at a proximal end 233 of the handle 220. The handle 220 is configured for gripping (by a hand) about a lengthwise (gripping) portion 221 of the handle between opposite ends thereof. The cutting heads 230, 330, at opposite ends of the handle, respectively, each provide at least part of or include an embedded blade cutter. An embedded blade (or blade) 212 and a tape splitter (or tape splitter component) 214 are secured within the first cutting head (that includes a box cutter), and an additional embedded blade (or blade) 312 is secured within the second cutting head 330 (that includes a film cutter). The housing 210 includes has a left side 222 and a right side 224 at opposite sides of the blades 212, 312 and the tape splitter 214. As shown in FIGS. 27 and 40, the handle 220 includes a recess (or recessed portion) 240 at a side thereof (e.g., a recessed side portion/area of the handle as shown). The housing 210 also includes a clip 250 that is connected to (or integrally formed with) the handle 220 between the two cutting heads 230, 330, the clip 250 including a resilient (arm) member 251 extending (generally lengthwise) along the handle (e.g., shaped/configured as shown). The housing 210 can be formed of various materials, for example, a moldable composite material (e.g., a material: glass-filled polymer or glass-filled plastic (GF), polytetrafluoroethylene (PTFE) nylon), and by various processes (e.g., insert molded). For example, the housing 210 can be molded or otherwise formed around the blades 212, 312 and the tape splitter 214 such that the left and right sides of the housing are (permanently) positioned in relation to each other with the blades 212, 312 and the tape splitter 214 secured therebetween and adjacent to each other (FIGS. 33, 36 and 37). The term "embedded blade" can refer (for example) to a blade that is secured within or to or otherwise connected to a cutting head and/or handle of a hand-held cutting tool. The blades 212, 312 can be formed of various materials, for example, steel (e.g., SAE 1095 steel heat treated to HRC 58-60). The tape splitter 214 can be formed of various materials, for example, steel (or a high strength plastic).

Figure 39:
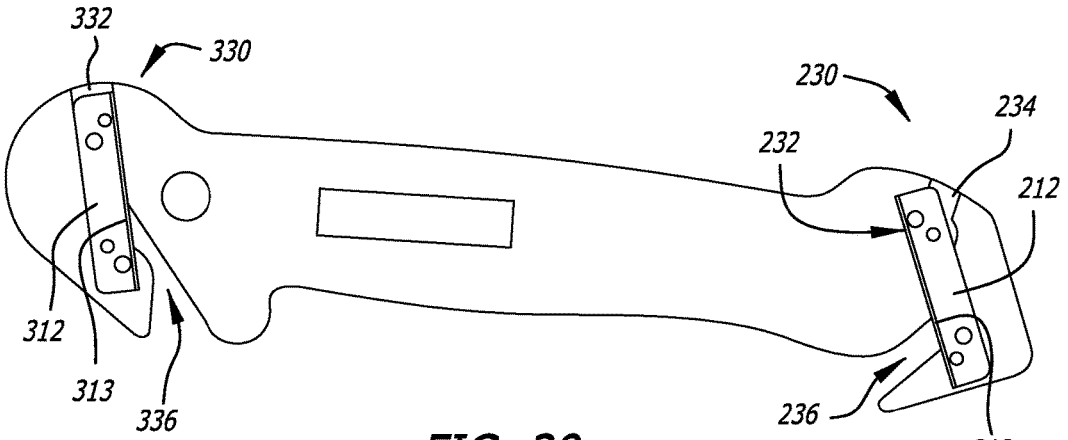
FIG. 39 a cross-sectional right side view of the cutter apparatus (of FIG. 21) showing blade receiving recesses/channels of the film cutter and the box cutter, respectively—the tape splitter are not shown in this view.
Figure 40:
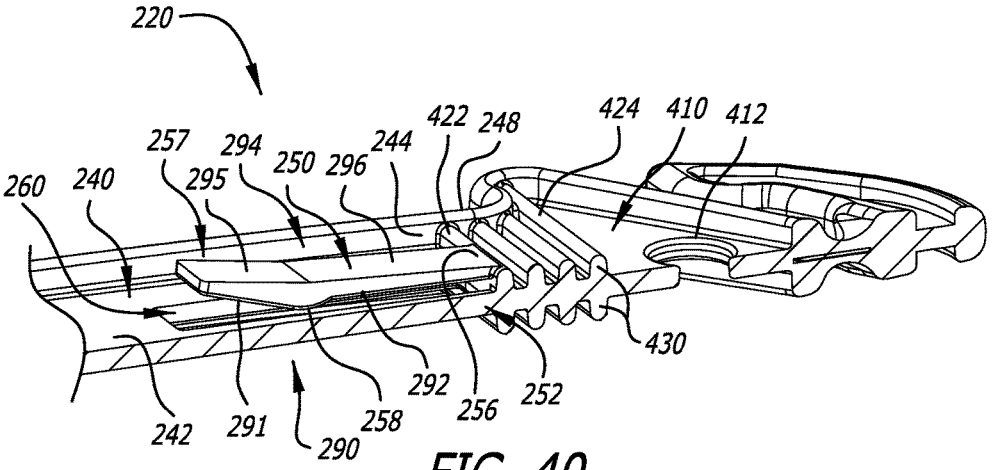
FIG. 40 is a cross-sectional isometric perspective view of the proximal end of the cutter apparatus showing a recess of the handle and a connection interface at which a clip is connected to the handle, the connection interface including an arcuate side wall portion of the recess (an arcuate side wall portion of a ridge or wall structure).

Referring to FIGS. 36 and 39, the first cutting head 230 includes the blade 212 secured within a blade receiving recess/channel 232, and the tape splitter 214 secured within a tape splitter (keyed) recess/channel 234 adjacent to the blade receiving recess/channel 232. The first cutting head 230 includes a (cutting) channel 236 formed as shown and extending into the blade receiving recess/channel 232. When secured within the blade receiving recess/channel 232, a cutting portion 213 of the blade 212 is located (e.g., visible/exposed) within the channel 236. The second cutting head 330 includes the blade 312 secured within a blade receiving recess/channel 332. The second cutting head 330 includes a (cutting) channel 336 formed as shown (see also FIG. 35, which shows channel 336 without blade 312) and extending into the blade receiving recess/channel 332. When secured within the blade receiving recess/channel 332, a cutting portion 313 of the blade 312 is located (e.g., visible/exposed) within the channel 336. In example embodiments, the embedded blades 212, 312 (or the cutting portions 213, 313 thereof) are coplanar (as shown in FIG. 39).

Referring to FIG. 27, the cutting portions 213, 313 include cutting edges 214, 314, respectively (visible/exposed within the cutting channels 236, 336 as shown). In example embodiments, the edge of one of the embedded blades forms an obtuse angle with a longitudinal axis of or associated with the handle. For example, and as shown in FIG. 27, the cutting edge 214 forms an obtuse angle with a longitudinal axis (denoted "LA") defined by a lengthwise surface of the clip 250 or of an opening 260 facing the clip 250, and the cutting edge 314 forms an acute angle with the longitudinal axis.

Referring to FIGS. 22 and 27, the handle 220 includes a (palm/hand/finger) guard 400 between the clip 250 and one of the embedded blade cutters—in this example embodiment, the second cutting head 330. The (palm/hand/finger) guard 400 includes a protrusion 402, transitioning at a periphery edge 404 thereof (at its widest portion laterally in relation to the handle sides) to an inside wall 338 of the (cutting) channel 336 within which the blade 312 of the embedded blade cutter is held. Referring to FIG. 27, the housing 210 includes, adjacent to the protrusion 400, a recessed portion (or recess) 410 including (or being provided with) an opening (or aperture) 412 therethrough (suitable for a lanyard, or to serve as a hanger hole). The handle 220 includes (a series of) ridges 420 laterally extending across the handle 220 adjacent to and in part defining the recessed portion 410. The clip 250 includes a base portion 256 connected (or otherwise secured) to the handle 220 between the (palm/hand/finger) guard 400 and one of the embedded blade cutters—in this example embodiment, the first cutting head 230.

Referring to FIGS. 27 and 40, the handle 220 includes a recess 240 (e.g., a recessed side portion/area) within which the clip 250 is secured to the handle 220 (e.g., integrally formed with or otherwise connected or secured to a ridge (or wall) that extends across the handle). The handle 220 includes a ridge 422 that (laterally) extends across the handle 220 (e.g., as shown), the ridge 422 (at portions thereof adjacent to the base 256 of the clip 250) defining inside wall portions 241 of the recess. The handle 220 includes an (arcuate) interconnection interface 252 (e.g., at the ridge 422, such as shown, that (laterally) extends across the handle) at which the base portion 256 of the clip 250 is secured (e.g., integrally formed with or otherwise connected) to the handle 220. The recess 240 also includes a (substantially planar) bottom surface (or area) 242 and adjoining periphery walls (or wall portions) (contiguous with the bottom surface or area, e.g., as shown) that define a periphery (or boundary) 246 of the recess 240. The handle 220 includes ridges (laterally) extending between periphery portions of the handle, the periphery portions including inside-facing walls/surfaces 244 (adjacent to the ridges) that in part define (sides of) the recess 240. The ridges 420 are recessed (e.g., as shown in FIG. 40, at the top (or apex) 424 of each ridge) in relation to adjacent top edges 248 of the periphery portions (of the handle). At both sides, the handle 220 includes gripping structure 430 including (a series of) ridges (ribs or other engagement elements) (laterally) extending across the handle, the ridges separating (and in part defining) recesses (or recessed areas) at opposite ends of the gripping structure—in this example embodiment, the recesses 240, 410 previously discussed.

Referring to FIGS. 22, 27 and 40, in this example embodiment, the clip 250 is only connected to or in contact with the handle 220 at an (arcuate) interconnection interface 252 (e.g., at a ridge, such as shown, that (laterally) extends across the handle) at which a base portion 256 of the clip 250 is secured (e.g., integrally formed with or otherwise connected) to the handle 220. The bottom surface (or area) 242 of the recess 240 includes the opening 260 facing the clip 250 and provided through the handle 220 as shown. The handle 220 includes surfaces 262 that define the opening 260 including a periphery boundary of the opening (e.g., at a bottom surface of the recess) circumscribing or generally being co-aligned with side surfaces(/portions) 254 of the clip 250 though, in this example embodiment, not circumscribing the base (or base portion) 256 of the clip 250. The recess 240 has a periphery (or boundary) 246 defined (at least in part) by side wall surfaces(/portions) 226 of the handle 220 and/or the (contiguous) side surfaces(/portions) 254 of the clip 250. Accordingly, the clip 250 is (integrally formed with or) connected at its base (portion) 256 to the handle at a location within (e.g., interconnection location or juncture of) the recessed portion 240 of the handle 220. The clip 250 is connected to or in contact with the handle 220 only at the (interconnection) location—independent of whether the resilient member 251 of the clip 250 flexes or otherwise repositions in relation to the base (portion) 256 of the clip 250.

Figure 30:
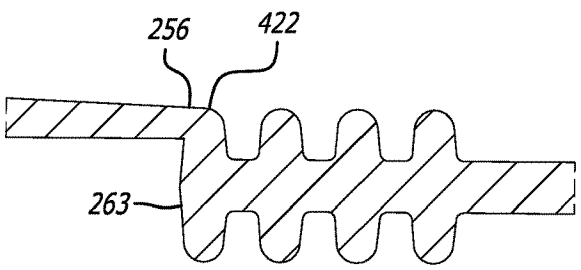
FIG. 30 is a cross-sectional magnified view of the cutter apparatus at lines C-C of FIG. 22 showing a series of ridges that includes an interconnection support structure and a clip extending therefrom.
Figure 32:
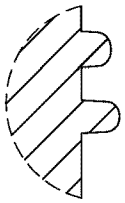
FIG. 32 is a cross-sectional view showing in isolation the portion of FIG. 31 denoted DETAIL E.
Figure 29:
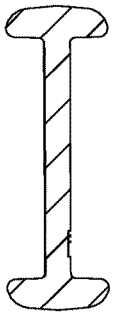
FIG. 29 is a cross-sectional view of the cutter apparatus at lines B-B of FIG. 22 showing side wall surfaces defining recesses at opposite (the left and right) sides of the handle.
Figure 31:
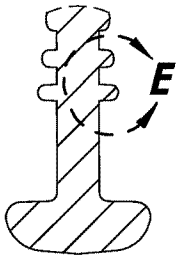
FIG. 31 is a cross-sectional magnified view of the portion of FIG. 28 denoted DETAIL D showing portions of the U-shaped gripping ridges in profile.
Figure 28:
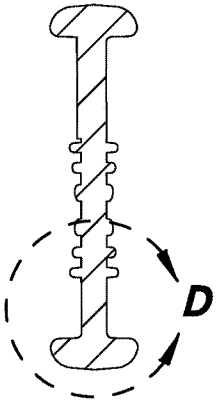
FIG. 28 is a cross-sectional view of the cutter apparatus at lines A-A of FIG. 22 showing generally U-shaped gripping ridges at left and right distal side portions of the handle.

The handle 220 includes (and the recess 240 is in part defined by) a ridge or wall structure (such as the ridge 422) at a proximal end 233 of the handle, and the clip 250 (at its base portion 256) is (integrally formed with or) connected to ridge or wall structure. Referring additionally to FIG. 30, the handle 220 includes (and the recess 240 is in part defined by) a ridge (such as the ridge 422) adjacent to and contiguous with a portion 263 of the opening 260, and the clip 250 is connected at a base portion thereof to the ridge.

Thus, in an example embodiment, a hand-held cutting tool includes a handle configured for gripping (by a hand) about a lengthwise (gripping) portion of the handle between opposite ends thereof, two cutting heads, at the opposite ends of the handle, respectively, the cutting heads each providing at least part of or including an embedded blade cutter, and a clip (integrally formed with or) connected to the handle between the two cutting heads. In example embodiments, each of the cutting heads has a blade (an embedded blade) that is secured within or to (e.g., connected to) the cutting head, a cutting portion thereof being located (e.g., visible/exposed) within a channel (or other opening, recess or the like) of the cutting head.

Referring to FIGS. 22, 27 and 40, the clip 250 includes an angled end portion 257 at an opposite end of the clip in relation to the base portion 256, and the handle 220 includes (or is provided with) (concentric/equidistantly nested) generally U-shaped (raised) gripping ridges 280 (see also FIGS. 28, 31, 32 and 34) having beveled portions(/surfaces) 282 at the ends of each ridge (FIG. 34), the beveled portions 282 facing the angled end portion 257 of the clip 250.

Referring to FIGS. 22 and 40, the clip 250 includes an inwardly facing engagement portion 258 (for securing/clipping the tool to a pocket), e.g., a protrusion shaped/configured as shown, that is wider laterally in relation to the handle 220 than at either the base portion 256 or the angled end portion 257 of the clip 250. The clip 250 includes two generally planar surfaces 291, 292 at and defining different (non-adjacent) portions of an inward facing side 290 of the clip 250, the planar surfaces not being parallel in relation to each other (e.g., not located within respective planes that are parallel to each other). The engagement portion 258 transitions (curves) between the two generally planar surfaces 291, 292 (e.g., as shown). The clip 250 also includes two generally planar surfaces 295, 296 at and defining different (adjacent and contiguous) portions of an outward facing side 294 of the clip 250, the planar surfaces not being parallel in relation to each other (e.g., not located within respective planes that are parallel to each other).

Thus, in an example embodiment, a hand-held cutting tool includes a handle, at least one cutting head with an embedded blade, the at least one cutting head being connected to the handle, and a clip connected to the handle within a recess thereof, the clip including a resilient member extending generally lengthwise along the handle. Each of the cutting head(s) is connected to the handle at an end thereof (i.e., at one or the other of two ends of the handle along a lengthwise portion thereof). The clip is connected at a base portion thereof to the handle at a location within (e.g., an interconnection location or juncture of) the recess. The clip is only connected to or in contact with the handle at the location independent of whether the resilient member (of the clip) flexes or otherwise repositions in relation to the base portion of the clip. In example embodiments, the recess has a periphery (or boundary) defined (at least in part) by side wall surfaces(/portions) of the handle and side surfaces(/portions) of the clip. In example embodiments, the recess has a periphery (or boundary) defined (in part) by (contiguous)

side surfaces(/portions) of the clip. The handle includes an opening (therethrough), surfaces of the handle that define the opening, including a periphery boundary of the opening (e.g., at a bottom surface of the recess), circumscribing or generally being co-aligned with side surfaces(/portions) of the clip though not circumscribing the base of the clip. The handle includes (and the recess is in part defined by) a ridge or wall structure, and the clip is (integrally formed with or) connected at a base portion thereof to the ridge or wall structure. In example embodiments, the handle includes (and the recess is in part defined by) a ridge, e.g., adjacent to and contiguous with a portion of the opening, and the clip is (integrally formed with or) connected at a base portion thereof to the ridge. In example embodiments, the handle includes (and the recess is in part defined by) an annular or ring-like wall structure (e.g., that also defines, at its interior, a lanyard or hanger hole opening), and the clip is (integrally formed with or) connected at a base portion thereof to a periphery portion of the wall structure.

Although the present invention(s) has(have) been described in terms of the example embodiments above, numerous modifications and/or additions to the above-described embodiments would be readily apparent to one skilled in the art. It is intended that the scope of the present invention(s) extend to all such modifications and/or additions.

What is claimed is:

1. A hand-held cutting tool comprising:

a handle configured for gripping by a hand about a lengthwise gripping portion of the handle between opposite ends thereof;

two cutting heads, at the opposite ends of the handle, respectively, the cutting heads each providing at least part of or including an embedded blade cutter; and a clip connected to the handle between the two cutting heads, the clip including a resilient member extending along the handle;

wherein the handle includes a gripping structure including ridges extending across the handle, the ridges separating recesses at opposite ends of the gripping structure;

wherein one of the recesses includes an opening facing the resilient member of the clip and provided through the handle, the handle including surfaces that define the opening including a periphery boundary of the opening circumscribing or generally being co-aligned with side surfaces/portions of the clip.

2. The hand-held cutting tool of claim 1, wherein each of the embedded blade cutters has a blade that is secured within or to the cutting head, a cutting portion of the blade being located within a channel of the cutting head.

3. The hand-held cutting tool of claim 2, wherein each of the cutting portions includes a cutting edge, the cutting edge of one of the cutting portions of the blades forming an obtuse angle with a longitudinal axis of or associated with the handle.

4. The hand-held cutting tool of claim 2, wherein the blades of the embedded blade cutters, or the cutting portions of the blades, are coplanar.

5. The hand-held cutting tool of claim 1, wherein the handle includes a guard between the clip and one of the embedded blade cutters.

6. The hand-held cutting tool of claim 5, wherein the guard includes a protrusion, transitioning at a periphery edge thereof to an inside wall of a channel within which a blade of the one embedded blade cutter is held.

7. The hand-held cutting tool of claim 6, wherein the handle includes, adjacent to the protrusion, a recessed portion including an opening or aperture therethrough.

8. The hand-held cutting tool of claim 7, wherein the handle includes a series of ridges laterally extending across the handle adjacent to and in part defining the recessed portion.

9. The hand-held cutting tool of claim 5, wherein the clip includes a base portion connected to the handle between the guard and one of the embedded blade cutters.

10. The hand-held cutting tool of claim 1, wherein the clip is secured within the one recess to the handle, the clip including a base portion that is connected to the handle at an interconnection location within the one recess, the clip being only connected to or in contact with the handle at the interconnection location independent of whether the resilient member of the clip flexes or otherwise repositions in relation to the base portion of the clip.

11. The hand-held cutting tool of claim 10, wherein the handle includes a ridge that extends across the handle, the ridge defining inside wall portions of the one recess.

12. The hand-held cutting tool of claim 10, wherein the handle includes an arcuate interconnection interface at which the base portion of the clip is secured to the handle.

13. The hand-held cutting tool of claim 10, wherein the handle includes a series of ridges extending across the handle, one of the ridges providing/defining walls of the recess.

14. The hand-held cutting tool of claim 10, wherein the one recess includes a bottom surface or area and adjoining periphery walls of the handle.

15. The hand-held cutting tool of claim 10, wherein the handle includes ridges extending between periphery portions of the handle, the periphery portions including inside-facing walls/surfaces that in part define the one recess.

16. The hand-held cutting tool of claim 15, wherein the ridges are recessed in relation to adjacent top edges of the periphery portions.

17. The hand-held cutting tool of claim 1, wherein one of the recesses includes an opening or aperture therethrough sized for a lanyard, or to serve as a hanger hole.

* * * * *